US005626065A

United States Patent [19]

Cattini

[11] Patent Number: 5,626,065

[45] Date of Patent: May 6, 1997

[54] CUTTING DEVICE WITH AUTOMATIC SHARPENER

[75] Inventor: Flavio Cattini, Bergamo, Italy

[73] Assignee: F.K. Systema S.r.l., Dalmine, Italy

[21] Appl. No.: 317,884

[22] Filed: Nov. 30, 1994

Related U.S. Application Data

[63] Continuation-in-part of Ser. No. 57,323, May 5, 1993, abandoned.

[30] Foreign Application Priority Data

May 6, 1992 [IT] Italy ..... BS92A0050

[51] Int. Cl.[6] ..... B65D 7/12

[52] U.S. Cl. ..... 83/174; 83/697; 83/747; 451/295; 451/420

[58] Field of Search ..... 83/174, 940, 632, 83/747, 174.1, 697; 451/45, 261–265, 267, 293, 295, 419–421

[56] References Cited

U.S. PATENT DOCUMENTS

| | | | |
|---|---|---|---|
| 1,551,167 | 8/1925 | Orlow | 83/174 |
| 1,815,018 | 7/1931 | Wagner | 451/419 X |
| 2,822,844 | 2/1958 | Busch | 451/420 X |
| 3,548,699 | 12/1970 | Gerber et al. | 83/940 X |
| 3,719,113 | 3/1973 | Gerber et al. | 83/174 X |
| 4,485,595 | 12/1984 | Minamiyama et al. | 451/295 X |
| 5,090,281 | 2/1992 | Paulson et al. | 83/174 X |

FOREIGN PATENT DOCUMENTS

| | | | |
|---|---|---|---|
| 753706 | 7/1956 | United Kingdom | 451/420 |
| 13733 | 9/1991 | WIPO | 83/174 |

*Primary Examiner*—Rinaldi I. Rada
*Assistant Examiner*—Clark F. Dexter
*Attorney, Agent, or Firm*—McGlew & Tuttle

[57] ABSTRACT

The present invention pertains to a device for cutting materials and including a straight blade 10, to which are connected two sharpening units 13, 14 with angulation complementary to that of the cutting edge of the blade. Each sharpening unit 13, 14 comprises a support 15 and defines a chamber 16 for a piston 17 and a pneumatic motor 18 contained in the piston, and has an outlet shaft 19 supporting a diamond disk grinding wheel 20 which is advanced towards the blade to be sharpened.

7 Claims, 3 Drawing Sheets

CUTTING DEVICE WITH AUTOMATIC SHARPENER

This is a continuation-in-part application of application SER. No. 08/057,323 filed May 5, 1993, abandoned.

FIELD OF THE INVENTION

The present invention pertains to the field of devices for cutting materials with automatic cutting machines, and specifically pertains to improvements to these devices.

BACKGROUND OF THE INVENTION

For cutting materials with cutting machines, a device using a straight blade capable of reciprocating motions is already known as are other cutting means. This blade is usually operated by a connecting rod system and is supported by a head capable of rotation, as well as movements on and with a support carriage, in order to be able to change the direction of advancement of the blade and to perform the cutting according to :the desired course and in a programmed manner.

However, the blade requires periodic resharpening to maintain its cutting efficiency.

SUMMARY AND OBJECTS OF THE INVENTION

One of the improvements forming the object of the present invention particularly pertains to a sharpener unit for sharpening the blade in the cutting device. The sharpener unit consists of two units which are set facing one another to operate in succession, first the one then the other, on opposite sides of the cutting edge of the blade. Each sharpener unit comprising a disk grinding wheel which rotates and at the same time is axially adjustable for its approach to and removal frown the blade to be sharpened.

The functions of the blade and the sharpening unit are handled by pneumatic actuators in the support head. However, when the head has a revolving part or rotor for the directionality of the blade, it is not easy to carry and feed the pneumatic fluid to the various devices.

Another improvement of the present invention proposes a distribution system of the pneumatic fluid to the various actuators carried out by the support head, more precisely between a stationary part and a revolving part of the head. This gives 360° of freedom of rotation to the head for operating the blade in any direction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS In the drawings.

DETAILED DESCRIPTION OF THE PREFERRED EMBODIMENT

Figure 5:
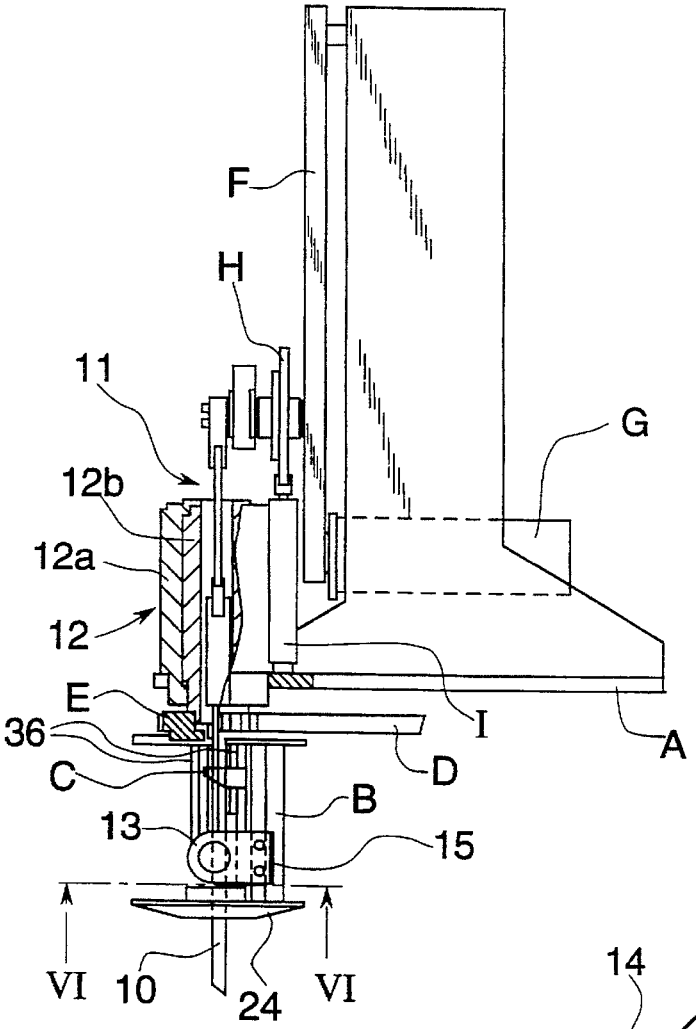
FIG. 5 is a partial cross sectional view of the entire assembly, including the blade, sharpening units, and head.
Figure 6:
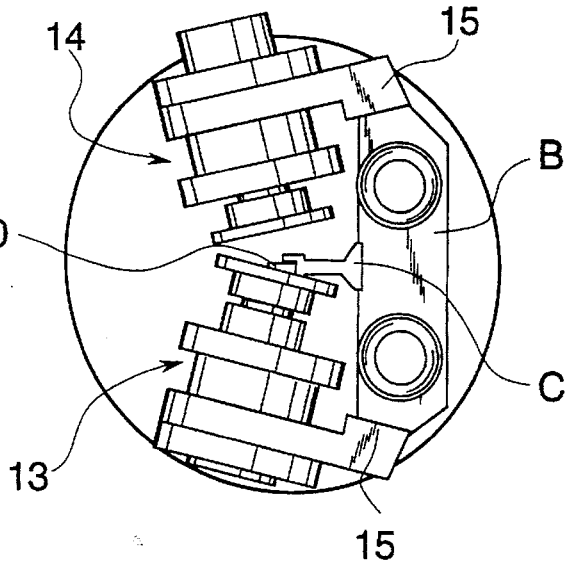
FIG. 6 is a view of the sharpening units attached to a bar.

Referring to the drawings and in particular to FIG. 5 there is a frame or body A which holds a blade 10. A blade motor G is mounted on the body A and is connected to a reciprocating means H by a belt F. The reciprocating means H is connected to the blade 10 in order to turn rotary motion of the blade motor G into reciprocating motion of the blade 10 by a connecting rod system 11. A cutting head 12 supports one end of the blade 10 and a portion of the connecting rod system 11 passes through an inside of the cutting head 12. The cutting head 12 is arranged in the body A.

Figure 2:
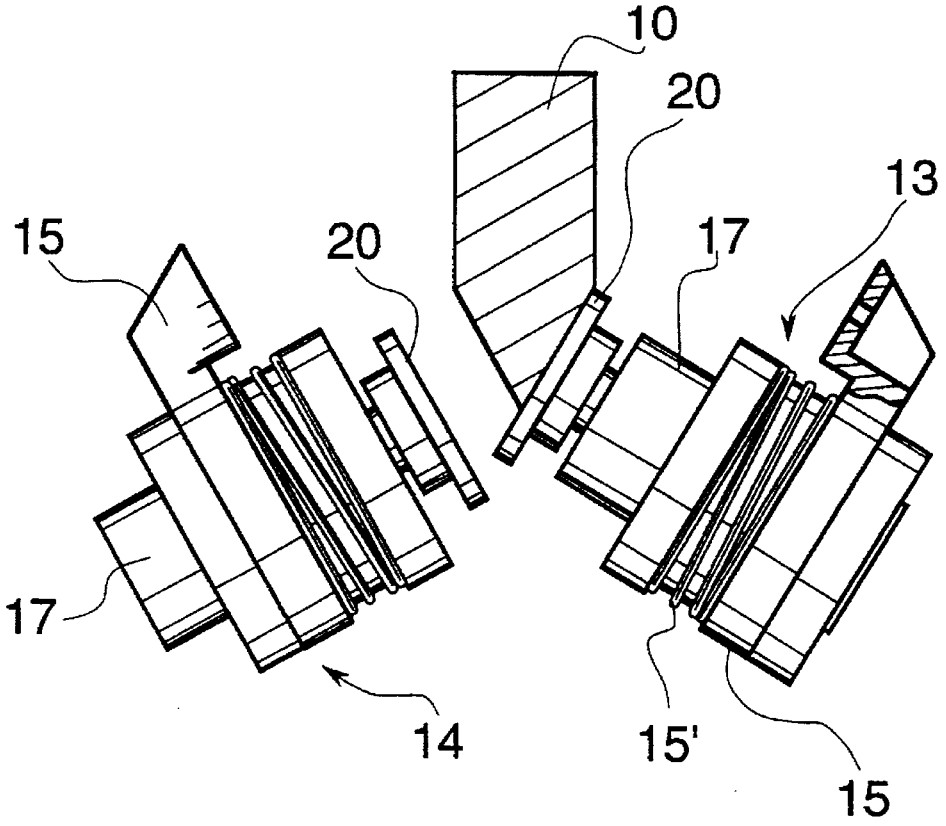
FIG. 2 shows a view of the two sharpening units arranged on opposite sides of a blade to be sharpened.

On the head 12 is mounted, by means of a bar B, sharpener means for sharpening the blade 10. The sharpener means includes two identical sharpening units 13, 14, arranged on opposite sides of the blade 10 and with an angulation complementary to that of the beveled surfaces or sides of the blade 10 which combine to form a cutting edge of the blade as shown in FIG. 2.

Figure 1:
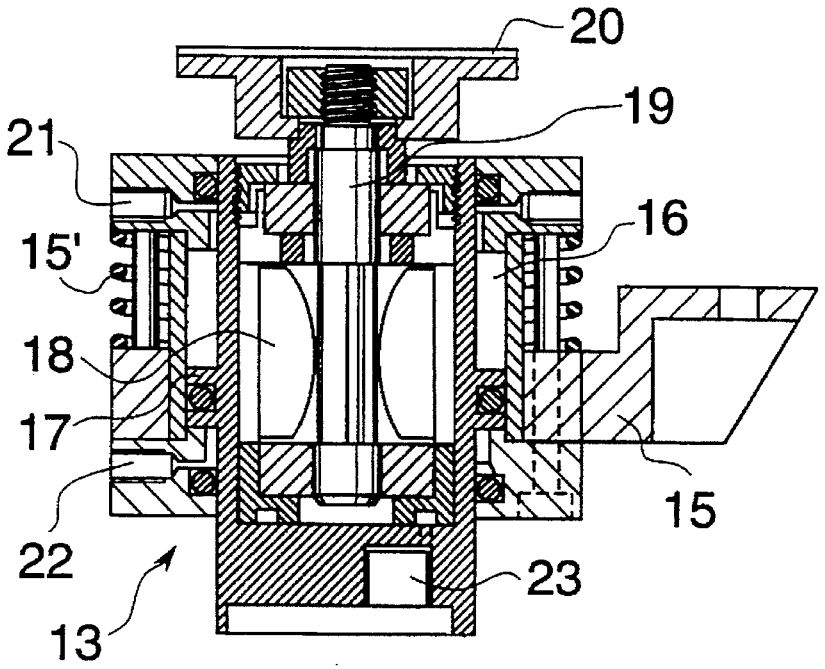
FIG. 1 shows a sharpening unit in axial section.

Each sharpening unit 13, 14 comprises a support 15, as shown in FIG. 1, attached to the head 12 by bar B. The sharpening units 13, 14 each define a chamber 16 in which a piston 17 slides. Axially mounted in the piston 17 is a small pneumatic motor 18 having an outlet shaft 19, to which is connected a diamond disk grinding wheel 20. The grinding wheel being movable towards and rotatable against one side of the cutting edge of the blade 10.

The axial adjustments of the piston 17 are operated by an aeriform fluid, such as air, which is alternately sent/discharged into the chamber 16 on opposite sides of the piston by means of inlet/outlet passages 21, 22.

The pneumatic motor 18 is fed with an aeriform fluid through motor fluid passage means 23 provided behind the piston. An outlet for the fluid fed through the pneumatic motor 18 can be provided adjacent the motor fluid passage means 23. A buffer spring 15' can be arranged around the unit to absorb or buffer impacts between the sharpening unit and the, support 15.

The approach and moving away of the grinding wheel 20 by axial adjustments of the piston 17, corresponds to the relative side of the blade to be sharpened, while the grinding wheel 20 rotates, actuated by the pneumatic motor 18.

The two sharpening units 13, 14 operate consecutively so that first the one—FIG. 2—then the other act on the two sides of the cutting edge of the blade.

Figure 4:
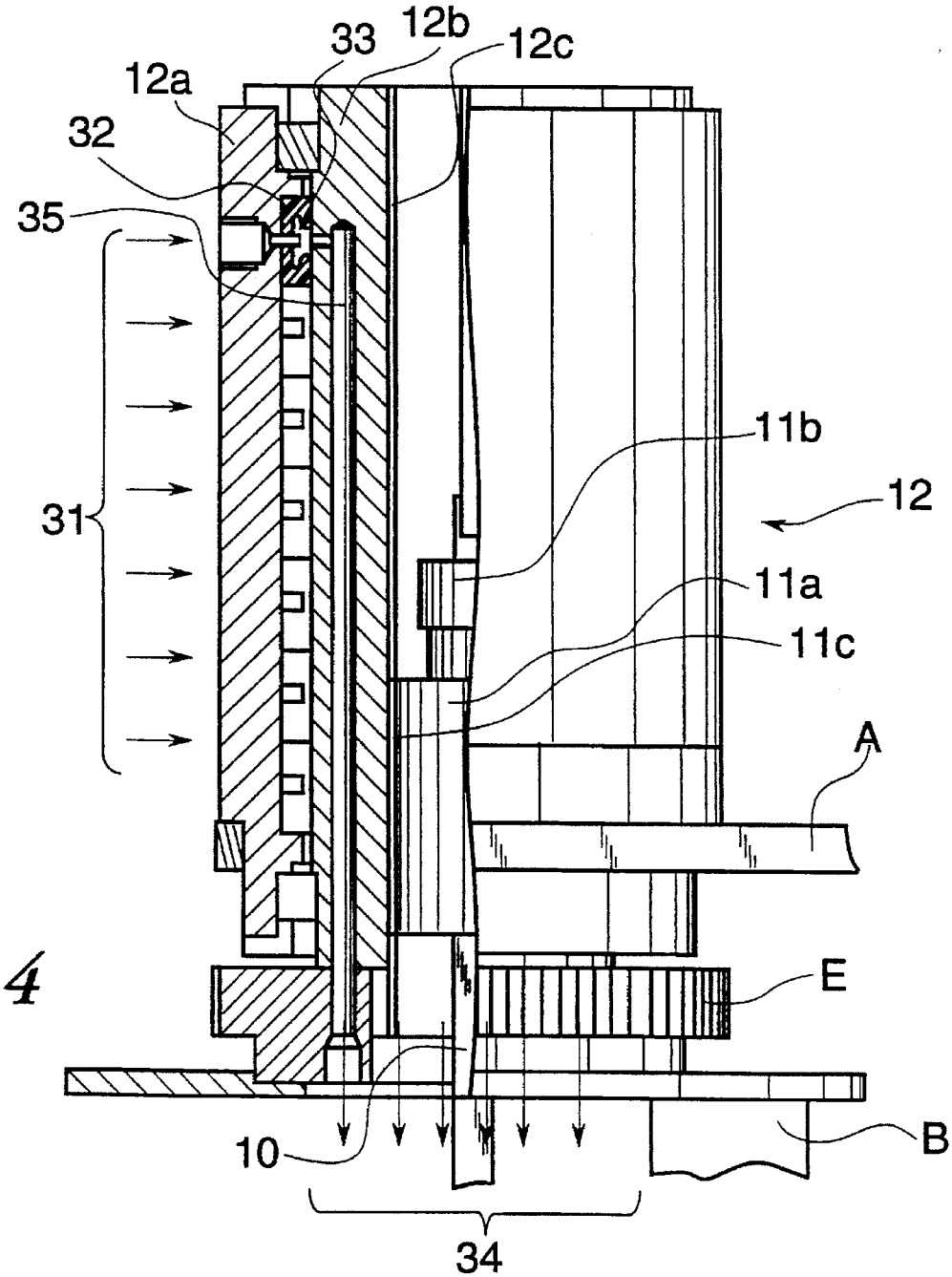
FIG. 4 shows, in partial longitudinal section, the pneumatic fluid distributor in the head.

The head 12 usually has—FIG. 4—an outer stationary part **12*a* and an inner part (rotor) 12*b* revolving in the outer part by means of an orientation motor (not shown). The rotor 12*b*** has a tooth wheel E which is connected to the orientation motor by a belt D in a known manner.

Figure 3:
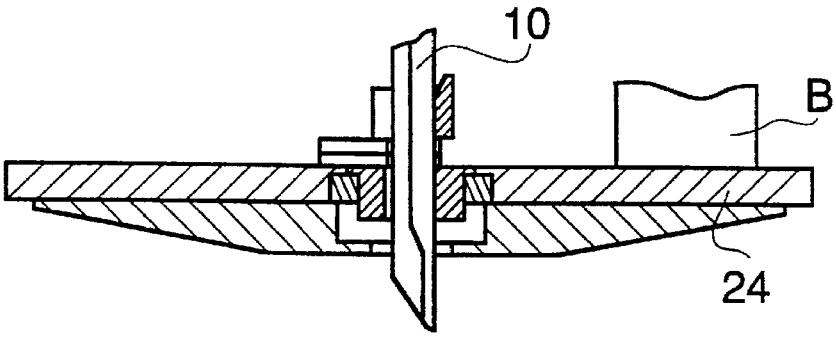
FIG. 3 shows a cross section of the blade :and pressure plate.

The cutting blade 10 is slidably mounted, by means of a portion **11*a* of the connecting rod system 11, in the rotor 12*b* for its orientation during the operation. The portion 11*a* of the connecting rod system 11 longitudinally slides in and rotates with the rotor 12*b* by any of several well known structure such as tab 11*c* in a longitudinal groove 12*c*. The portion 11*a* is also rotatably connected by, for example a rotating coupling 11*b*, to the rest of the connecting rod system about an axis of rotation of said cutting head rotor 12*b*. When the orientation motor moves the belt D, the rotor 12*b* is rotated through the toothed wheel E, the bar B is connected to the rotor 12***b* and rotates with it. All the elements attached to bar B, including the blade 10 in the guide, rotate with the rotor 12*b*. Moreover, the blade 10 extends through a pressure plate 24—FIG. 3—which is constrained and rotates with the rotor 12*b*. The pressure plate can be raised and lowered on the material to be cut by means of a pneumatic cylinder, not shown, between the rotor 12*b* and the pressure plate 24 which extends and contracts bar B, which can be telescoping for this purpose.

On the pressure plate 24 are mounted means C including a guide and sensors for indicating a dull blade, which are known in themselves, for maintaining the position of the blade and for setting the sharpener unit into motion when the blade starts to lose its cutting edge.

In order to pneumatically feed the actuators; for the various functions of the two sharpening units 13, 14 and at least the raising/lowering function of the plate 24, the head 12 is also used here as a pneumatic distributor.

As shown in FIG. 4, a variety of inlets, which are indicated by the arrows 31 and to which are connected the same amount of supply pipes of the aeriform fluid to be distributed, are provided in the outer stationary part 12*a* of the head 12. Each inlet 31 communicates, by means of an annular distribution chamber 33 with a pneumatic seal 32, having a channel 35 contained longitudinally in the rotor 12*b*. The channels halve an outlet according to the arrows 34 for feeding the pneumatic actuators: by means of tubes 36. For example, the first three outlets on the left in FIG. 4 feed the pneumatic motor, the starting and stopping of the piston which supports the grinding wheel of a sharpening unit 13, respectively. The second three outlets supply the same functions for the other sharpening unit and the remaining outlet feeds the actuator for raising/lowering the plate.

However, it should be noted that other inlets and other Outlets can be provided for other possible functions in the head, for example, for generating a cooling air flow and/or for polishing the blade.

While a specific embodiment of the invention has been shown and described in detail to illustrate the application of the principles of the invention, it will be understood that the invention may be embodied otherwise without departing from such principles.

What is claimed is:

1. A self-sharpening cutting device for cutting material, the cutting device comprising:

a body;

reciprocating means mounted on said body for providing a reciprocating motion in a cutting direction;

a blade connected to said reciprocating means, said blade having two beveled surfaces combining to form a cutting edge;

head means mounted on said body and guiding said blade for positioning said blade in a plurality of different angular positions, said head means including a stationary outer part mounted on said body and an inner part rotatable with respect to said outer part, said blade being guided by slidably contacting said inner part of said head means, said stationary outer part of said head means defining a plurality of radial fluid inlets, said inner part defining a plurality of longitudinal channels, said outer and inner parts also defining a plurality of annular distribution chamber means, each of said annular distribution chamber means being for communicating one of said plurality of radial fluid channels with one of said plurality of longitudinal channels;

first and second sharpening means connected to and moveable with said head means for sharpening said blade, each of said first and second sharpening means being spaced substantially perpendicular from one of said beveled surfaces, each of said sharpening means including a sliding chamber and a piston slidable in said sliding chamber in a sharpening direction toward and substantially perpendicular to a respective one of said beveled surfaces, each piston of each of said first and second sharpening means including a pneumatic motor movable with said respective piston, each pneumatic motor having an outlet shaft substantially aligned in a respective one of said sharpening directions and each outlet shaft having a grinding wheel attached thereto with a grinding surface substantially parallel with said respective beveled surface, each of said first and second sharpening means also including inlet/outlet passage means for guiding fluid in and out of said slidable chamber to move said piston towards and away from said respective beveled surface, each of said first and second sharpening means also including motor fluid passage means for guiding fluid to said pneumatic motor.

2. The self-sharpening cutting device in accordance with claim 1, wherein: said motor fluid passage means includes tubes connecting said longitudinal channels with said inlet/outlet passage means.

3. A self-sharpening cutting device for cutting material, the cutting device comprising:

a body;

reciprocating means mounted on said body for providing a reciprocating motion in a cutting direction;

a blade connected to said reciprocating means, said blade having two beveled surfaces combining to form a cutting edge;

head means mounted on said body and guiding said blade for positioning said blade in a plurality of different angular positions, said head means including a stationary outer part mounted on said body and an inner part rotatable with respect to said outer part, said blade being guided by said inner part of said head means, said stationary outer part of said head means defining a plurality of radial fluid inlets, said inner part defining a plurality of longitudinal channels, said outer and inner parts also defining a plurality of annular distribution chamber means, each of said annular distribution chamber means being for communicating one of said plurality of radial fluid channels with one of said plurality of longitudinal channels;

sharpening means mounted on said inner part of said head means for sharpening said blade, said sharpening means being spaced substantially perpendicular from at least one of said beveled surfaces, said sharpening means including a sliding chamber and a piston slidable in said sliding chamber in a sharpening direction toward and substantially perpendicular to a respective one of said beveled surfaces, said piston including a motor movable with said piston, said motor having an outlet shaft substantially aligned in said sharpening direction and said outlet shaft having a grinding wheel attached thereto with a grinding surface substantially parallel with said respective one of said beveled surfaces, said sharpening means also including inlet/outlet passage means for guiding fluid in and out of said slidable chamber to move said piston towards and away from said respective one of said beveled surfaces, said sharpening means including tubes connecting said longitudinal channels with said inlet/outlet passage means.

4. The self-sharpening cutting device in accordance with claim 3, further comprising:

a pressure plate connected to said inner part of said head means for positioning against material to be cut.

5. The self-sharpening cutting device in accordance with claim 3, further comprising:

connecting rod means for connecting said blade to said reciprocating means, said connecting rod means including a portion connected to an end of said blade, said portion of said connecting rod means being longitudinally slidable inside said inner part of said head means and rotatable with said head means, said portion of said connecting rod means being rotatable with respect to a remainder of said connecting rod means.

6. A self-sharpening cutting device for cutting material, the cutting device comprising:

a body:

reciprocating means mounted on said body and for providing a reciprocating motion in a cutting direction;

a blade having at least one beveled surface forming a cutting edge, said blade being connected to said reciprocating means;

head means connected to said body for positioning said blade in a plurality of different angular positions, said head means including a stationary outer part and an inner part rotatable with respect to said outer part, said head means including passage means for passing fluid into said outer part, then into said inner part, and then out of said inner part;

sharpening means connected to said inner part of said head means and movable into said plurality of angular positions with said inner part of said head means, said sharpening means for sharpening said blade, said sharpening means being spaced substantially perpendicular from said bevel surface, said sharpening means including a sliding chamber and a piston slidable in said sliding chamber in a sharpening direction toward and substantially perpendicular to said beveled surface, said piston including a motor movable with said piston, said motor having an outlet shaft substantially aligned in said sharpening direction and said outlet shaft having a grinding wheel attached thereto with a grinding surface substantially parallel with said beveled surface, said sharpening means also including inlet/outlet passage means for guiding said fluid in and out of said slidable chamber to move said piston towards and away from said beveled surface.

7. The self-sharpening cutting device in accordance with claim 6, wherein:

said passage means includes a plurality of radial fluid inlets defined by said outer part of said head means and, a plurality of longitudinal channels defined by said inner part, said passage means also including a plurality of annular distribution chamber means defined by said inner and outer parts, each of said annular distribution chamber means being for communicating one of said plurality of radial fluid channels with one of said plurality of longitudinal channels; and tubes connecting said inlet/outlet passage means to said longitudinal channels.

* * * * *